US007055209B2

(12) United States Patent
Zalewski

(10) Patent No.: US 7,055,209 B2
(45) Date of Patent: Jun. 6, 2006

(54) METHOD AND APPARATUS FOR CONVERTING A SOOTBLOWER FROM A SINGLE MOTOR TO A DUAL MOTOR DRIVE

(75) Inventor: Gerald F. Zalewski, Greer, SC (US)

(73) Assignee: JSS Power Solutions, LLC, Tulsa, OK (US)

( * ) Notice: Subject to any disclaimer, the term of this patent is extended or adjusted under 35 U.S.C. 154(b) by 608 days.

(21) Appl. No.: 10/406,871

(22) Filed: Apr. 4, 2003

(65) Prior Publication Data

US 2004/0194246 A1 Oct. 7, 2004

(51) Int. Cl.
*A47L 5/38* (2006.01)

(52) U.S. Cl. ..... 15/316.1; 15/317; 122/390

(58) Field of Classification Search ..... 15/316.1, 15/317, 318; 122/390
See application file for complete search history.

(56) References Cited

U.S. PATENT DOCUMENTS 4,492,187 A * 1/1985 Hammond ..... 15/316.1
5,579,726 A * 12/1996 Finucane ..... 15/316.1
5,605,117 A 2/1997 Moskal
5,619,771 A * 4/1997 Minic ..... 15/316.1
6,575,122 B1 * 6/2003 Hipple ..... 15/316.1
6,892,679 B1 * 5/2005 Jameel et al. ..... 15/316.1

* cited by examiner

*Primary Examiner*—Theresa T. Snider
(74) *Attorney, Agent, or Firm*—Carothers & Carothers

(57) ABSTRACT

A single motor rack and pinion driven sootblower is converted to a dual motor version. The single motor version includes a lance tube which is advanced and retracted transversely on a carriage and is further rotationally driven by a translational mechanical drive which rotates the lance tube as it is being axially driven. The conversion is accomplished by disengaging the translational drive by removing the original drive hub within the drive housing of the carriage and this original drive hub is substituted with a tubular rotary drive hub which is not in driving engagement with the translational drive when installed. A second rotational motor is then mounted on the carriage assembly and connected to externally exposed portions of the substitute hub through a gear drive for independently rotating the substitute hub and thereby independently rotating the lance tube about its axis. The two motors are then independently controlled through the use of a microprocessor to provide infinite indexing possibilities for the lance tube.

6 Claims, 3 Drawing Sheets

METHOD AND APPARATUS FOR CONVERTING A SOOTBLOWER FROM A SINGLE MOTOR TO A DUAL MOTOR DRIVE

BACKGROUND OF THE INVENTION

This invention generally relates to boiler cleaning. More specifically, the invention relates to a retracting sootblower having a mechanism for articulating the sootblower and lance tube so that the lance tube can be inserted over multiple insertion axes through a single access port in a boiler.

Sootblowers are used to project a stream of blowing medium, such as water, air, or steam, against the heat transfer surfaces of the tube bank located within the boiler. The blowing medium is used to dislodge various combustion byproducts, including slag and ash, which becomes deposited on the heat transfer surfaces. If the encrustations are not removed, boiler efficiency significantly decreases. By using the blowing medium to dislodge the encrustation, the thermal and mechanical shock provided by the medium fractures the encrustations, breaking them free, and dislodges them from the heat transfer surfaces. Through effective and consistent sootblowing, the efficiency of the boiler can be maintained.

The present invention pertains to sootblowers of the type or category which are retractable. A retractable sootblower is located outside of the boiler and its lance tube is periodically advanced into and withdrawn from the boiler to perform cleaning. One or more nozzles are located on the end of the lance tube and project jets of the blowing medium. While being inserted and retracted, the lance tube is rotated so that the jets trace helical paths across the heat transfer surfaces.

The present invention pertains to the modification of a retractable sootblower of the type illustrated in U.S. Pat. No. 5,605,117 which is articulable so that the lance tube can be inserted into and retracted from a boiler over multiple insertion axes, but through a single or common access port. The sootblower includes an exteriorly located frame mounted adjacent to a wall box or access port in the boiler wall. A carriage assembly is supported by the frame and coupled to a lance tube which has at least one nozzle at its distal end. The lance tube generally defines the axes along which it will be inserted into and withdrawn from the interior of the boiler. As the lance is inserted, retracted or both, it is also rotated by the carriage assembly through a mechanical translational drive.

An advantage of this type of single motor rack and pinion driven sootblower is that it is economical to manufacture. The single motor is used not only for translational drive of the carriage assembly, but also used to rotationally drive the lance tube through the mechanical translational gear drive. This single motor is generally driven through the use of a programmable controller.

However, a disadvantage of such a single motor rack and pinion driven sootblower is that the mechanical translational drive provides fixed indexing of the rotational drive for the lance tube and the lance tube rotation is a function of the traversing speed. Accordingly, as is taught, for example, in the disclosure of U.S. Pat. No. 5,579,726, it is preferable that such retractable rack and pinion driven sootblowers have separate independent motors for transverse drive of the carriage assembly and rotational drive of the lance tube. This permits independent driving of the two motors through the use of a microprocessor which permits infinite indexing for both reverse helix cleaning and cross helix cleaning and the ability to switch the pitch during sootblower operation and to change the oscillating mode.

Accordingly, it is a principal object of the present invention to provide a method and apparatus for converting a retractable single motor driven sootblower of the type disclosed in U.S. Pat. No. 5,605,117 to a dual motor drive for independently controlling the traversing motor and the rotary motor for thus enhancing the cleaning ability of the sootblower by allowing the motion of the lance tube to be infinitely changed or varied.

SUMMARY OF THE INVENTION

The novel method and apparatus of the present invention is provided for converting a sootblower from a single motor to a dual motor drive version. Such single motor drive sootblowers have a movable lance tube with a hollow interior for ejecting a cleaning fluid under pressure from a distal end of the tube, and they have a detachable proximal end portion configured as an original tubular rotary drive hub. The rotary drive hub is received in a rotary bearing housing which is secured to the carriage assembly. The carriage assembly is driven by a traversing motor for driving the lance tube axially to both extend and retract the lance tube. A termination end portion of the original drive hub is exposed at a proximal end of the bearing housing for connection to a source of cleaning fluid under pressure to the hollow interior of the lance tube. A translational drive is provided on the carriage assembly to translate the transverse movement of the carriage assembly into a rotational drive for the lance tube. The translational drive is connected for, causing rotational driving of the original tubular rotary drive hub for the lance tube in the bearing housing as the lance tube is being axially driven for thereby rotating the lance tube about its axis.

The conversion technique of the present invention is accomplished by disengaging the translational drive by removing the original drive hub and replacing it with a substitute tubular rotary drive hub which is not in driving engagement with the translational drive when installed. A second rotational motor is then mounted on the carriage assembly and connected through a gear drive to exposed portions of the substitute hub for independently rotating the substitute hub and thereby independently rotating the lance tube about its axis. The traversing motor and the rotary motor are independently driven, preferably through the use of a microprocessor, for thereby creating custom traversing and rotational movement patterns for the lance tube.

BRIEF DESCRIPTION OF THE DRAWINGS

Other objects and advantages appear hereinafter in the following description and claims. The accompanying drawings show, for the purpose of exemplification, without limiting the scope of the invention or appended claims, certain practical embodiments of the present invention wherein:

DETAILED DESCRIPTION OF A PREFERRED EMBODIMENT

Figure 1:
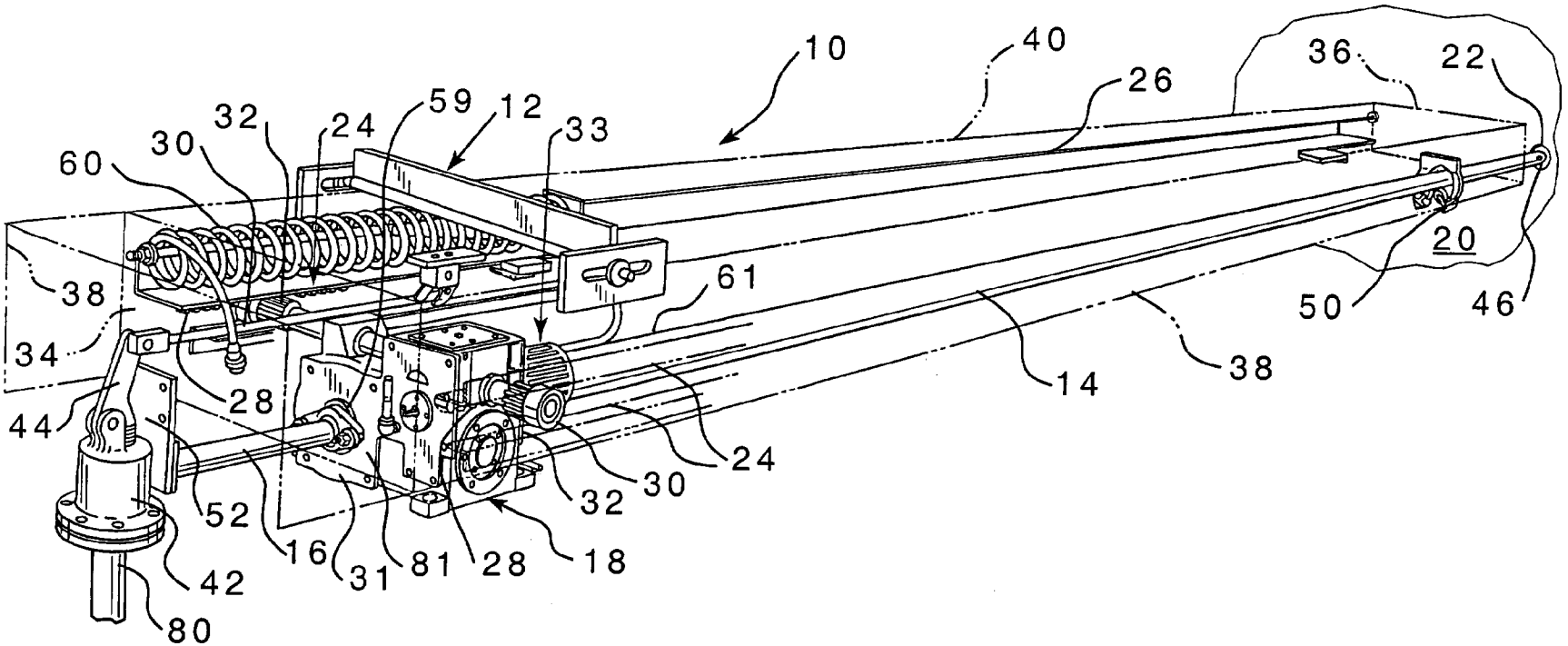
FIG. 1 Prior Art
FIG. 1 is a perspective view of a prior art retractable sootblower of the single motor rack and pinion driven category with the sootblower frame illustrated in phantom, to be converted to a dual motor version in accordance with the teachings of the present invention.

Referring now to FIG. 1, a sootblower is generally designated at 10 and illustrates a single motor rack and pinion sootblower of the prior art to be converted by the teachings of the present invention. This prior art sootblower is described in U.S. Pat. No. 5,605,117 and accordingly the same description and numeral designation are followed for conformity. The sootblower 10 principally comprises a frame 12, a lance tube 14, a feed tube 16, and a carriage assembly 18.

The sootblower 10, shown in its retracted horizontal position is located adjacent to a boiler wall 20 so that the lance tube 14 is aligned with an axis port 22. The port 22 permits the lance tube 14 to enter into the boiler to perform cleaning of the heat exchanger surfaces located within. Upon actuation, the carriage assembly 18 will cause transverse movement of the lance tube 14 along its axis for extending into and then retracted it from the boiler.

The carriage assembly 18 is capable of causing transverse movement of the lance tube 14 because it includes a transmission and drive system located within the carriage housing 31. The transmission and drive system move the carriage assembly 18 along a pair of rack assemblies 24 located on opposite, interior sides of the frame 12. The rack assemblies 24 are made up of sections of angle iron 26, welded or otherwise secured to the interior sidewall of the frame 12, which support downwardly toothed racks 28. A pair of carriage rollers 30 are mounted to the carriage housing 31 so as to rest on top of the angle iron 26 and support the carriage assembly 18. Beneath the carriage rollers 30 are pinion gears 32 which engage the toothed racks 28. The pinion gears 32 are coupled through the transmission (not shown and located within the housing 31) to a motor 33 which is in turn connected to a programmable controller (not shown) that will initiate a cleaning cycle as needed and according to the operational characteristics of the boiler itself. The transmission not only causes transverse movement of the lance tube 14, but it also includes a mechanical translational drive which simultaneously causes rotational movement of the lance tube 14 as well as the lance tube 14 is being axially driven.

The frame 12 of the sootblower 10 includes an outboard end wall 34, and inboard end wall 36 and a pair of opposed sidewalls 38, to which the rack assemblies 24 are mounted as described above. Additionally, the top of the frame 12 may be covered with panels 40 to enclose and protect both the carriage assembly 18 and the lance tube 14. While only one variety of sootblower frame 12 is shown in the figures, it should be well understood that there are many alternative frame designs.

The feed tube 16 is coupled at the rear end of the sootblower 10 to a poppet valve 42 which is typically mounted to a support bracket 52 which is secured to the outboard end wall 34 of frame 12. The feed tube 16 conducts a blowing medium whose flow is controlled through the action of the poppet valve 42. Linkages 44 actuate the poppet valve 42 and are triggered by the carriage assembly 18 as it begins to move forward and insert the lance tube 14 into the boiler. Upon retraction of the lance tube 14 and rearward movement of the carriage assembly 18, the carriage assembly 18 again triggers the linkage 44 to shutoff the flow of blowing medium. The lance tube 14 over fits the feed tube 16 and a packing gland (not shown) creates a fluid seal between them. In this manner, the blowing medium is conducted from the feed tube 16 into the lance tube 14 for discharge from nozzles 46 located at the distal end of the lance tube 14.

A coiled electric cable 60 provides power to the drive motor 33 as the motor 33 moves with the carriage assembly 18 during insertion and retraction. A front support 50 includes bearings which support the lance tube 14 during its longitudinal and rotation movements. For longer lance tube 14 lengths, an intermediate support (not shown) may be provided to prevent excess of bending or deflection of the lance tube 14. Additional details of the construction and operation of this well known design may be found in U.S. Pat. No. 5,605,117.

As previously explained, the translational drive contained within housing 31 is connected for causing rotational driving of lance tube 14 as the lance tube 14 is being transversely inserted into and retracted from boiler wall 20. This is accomplished because the mechanical translational gear drive within housing 31 rotates original tubular rotary drive hub 59 in a known and conventional manner. The proximal end 61 of lance tube 14 is connected to the forward end of original rotary drive hub 59 on the forward face of housing 31 so that as original tubular rotary drive hub is rotated within housing 31, so also is lance tube 14 for thereby rotating lance tube about its axis.

Figure 2:
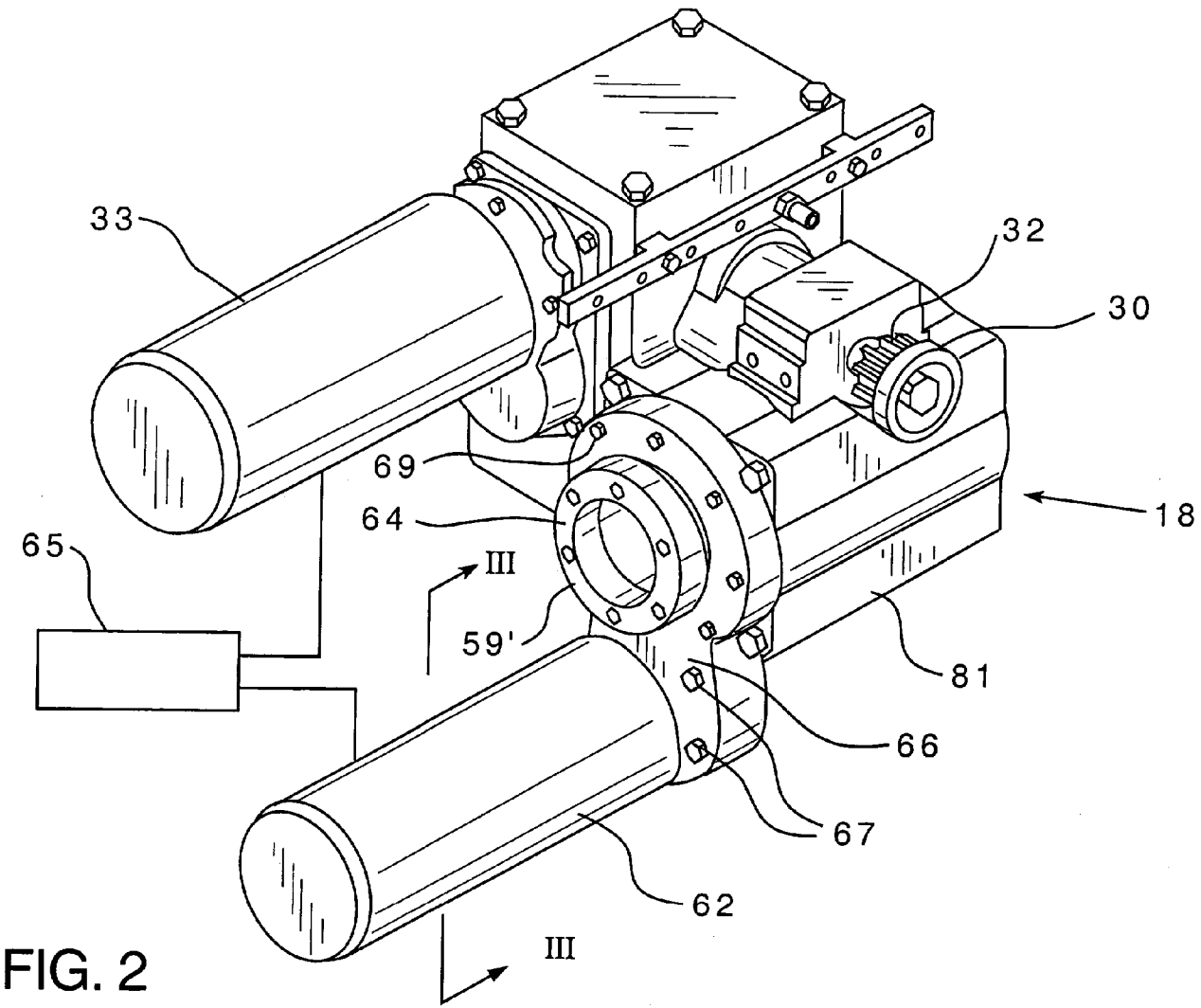
FIG. 2 is an enlarged perspective view of the carriage assembly portion of the sootblower illustrated in FIG. 1 as shown from the reverse end and adapted to a dual motor drive in accordance with the teachings of the present invention, and with the microprocessor controller therefore shown in schematic form.
Figure 3:
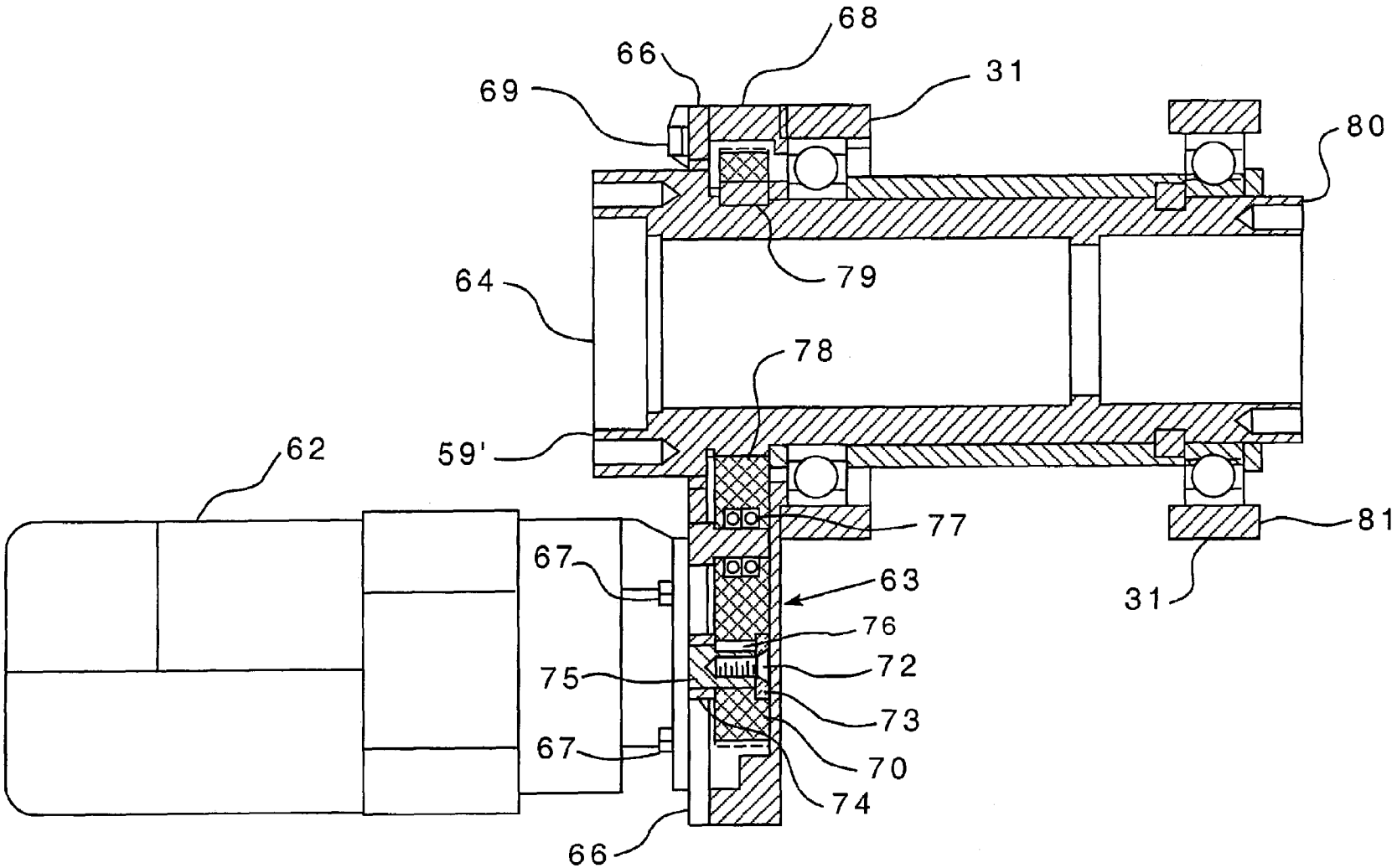
FIG. 3 is a view in side elevation of the carriage assembly shown in FIG. 2 as seen in partial vertical mid section along section line III-III.

The conversion method and apparatus of the present invention for converting a single motor rack and pinion driven sootblower to a dual motor version is illustrated in FIGS. 2 and 3. In order to carry out the conversion, the translational drive contained within housing 31 is disengaged by removing the original drive hub 59 from the housing 31 and replacing it with substitute tubular rotary drive hub 59' which is not in driving engagement with the translational drive when the new substitute rotary drive hub is installed. In fact, one or more internal gears (not shown) for the translational drive may also be removed. Then a second gear motor designated as rotational motor 62 is installed on the carriage assembly 18 and connected through gear drive 63 (FIG. 3) to exposed exterior portions of substitute hub 59' for independently rotating substitute hub 59' and thereby independently rotating lance tube 14 about its axis, as lance tube 14 will be connected at its proximal end 61 to the forward face 64 of substitute hub 59' in the same manner that it was previously connected to the forward face of original hub 59. Motors 33 and 62 are thereafter independently driven for thereby creating custom traversing and rotational movement patterns of lance tube 14 through the use of microprocessor 65.

Rotational motor 62 is fastened to cover plate 66 with stud and nut combinations 67. The cover plate 66 is then bolted to the rotary motor adapter 68 by stud and nut combinations 69. Motor gear 70 is attached to rotational motor 62 by the combination of machine screw 72, washer 73 and spacer 74 which secures gear 70 to motor shaft 75 with key 76. Gear 70 in turn drives idler gear assembly 77 and this idler gear assembly in turn drives hub gear 78 which rotationally drives hub 59'. Gear 78 is keyed to hub 59' by key 79. The proximal end 61 of lance tube 14 is connected to the face 64 of substitute hub 59' and the feed tube 16 is connected through a packing gland to the termination end portion 80 of substitute drive hub 59', exposed at the proximal end 81 of bearing housing 31 for connection to the source of cleaning fluid under pressure.

I claim:

1. A method of converting a sootblower from a single motor to a dual motor drive, said sootblower having a movable lance tube with a hollow interior for ejecting a cleaning fluid under pressure from a distal end thereof and having a detachable proximal end portion configured as an original tubular rotary drive hub received in a rotary bearing housing which is secured to a carriage assembly driven by a traversing motor for driving said lance tube axially to both extend and retract said lance tube, a termination end portion of said original drive hub exposed at a proximal end of said bearing housing for connection to a source of cleaning fluid under pressure to the hollow interior, and a translational drive connected for causing rotational driving of said original tubular rotary drive hub for said lance tube in said bearing housing as said lance tube is being axially driven for thereby rotating said lance tube about its axis; the method comprising:

disengaging said translational drive by removing said original drive hub and replacing it with a substitute tubular rotary drive hub which is not in driving engagement with said translational drive when installed;

mounting a rotational motor on said carriage assembly and connecting said rotational motor through a gear drive to portions of said substitute hub exposed exteriorly of said housing for independently rotating said substitute hub and thereby independently rotating said lance tube about its axis.

2. The method of claim 1, including independently driving said motors for thereby creating custom traversing and rotational movement patterns for said lance tube.

3. The method of claim 2, including independently driving said motors with a microprocessor.

4. In a single motor sootblower having a movable lance tube with a hollow interior for ejecting a cleaning fluid under pressure from a distal end thereof and having a detachable proximal end portion configured as an original tubular rotary drive hub received in a rotary bearing housing which is secured to a carriage assembly which is driven by a traversing motor for driving said lance tube axially to both extend and retract said lance tube, a termination end portion of said original drive hub exposed at a proximal end of said bearing housing for connection to a source of cleaning fluid under pressure to the hollow interior, and a translational drive connected for causing rotational driving of said original tubular rotary drive hub for said lance tube in said bearing housing as said lance tube is being axially driven for thereby rotating said lance tube about its axis; the improvement comprising:

means for disengaging said translational drive, including a substitute tubular rotary drive hub for replacing said original drive hub, said substitute hub configured whereby it is not in driving engagement with said translational drive when installed;

a rotational motor mounted on said carriage assembly and connected through a gear drive to portions of said substitute hub exposed exteriorly of said housing for independently rotating said substitute hub and thereby independently rotating said lance tube about its axis.

5. The sootblower of claim 4, including drive means connected for independently driving said motors for thereby creating custom traversing and rotational movement patterns for said lance tube.

6. The sootblower of claim 5, wherein said drive means includes a microprocessor.

* * * * *